US006708516B2

(12) United States Patent
Nakagawa et al.

(10) Patent No.: US 6,708,516 B2
(45) Date of Patent: Mar. 23, 2004

(54) AIR CONDITIONER

(75) Inventors: Hidetomo Nakagawa, Tokyo (JP); Masao Nagano, Tokyo (JP); Isao Funayama, Tokyo (JP); Toshiaki Yoshikawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/404,325

(22) Filed: Apr. 2, 2003

(65) Prior Publication Data

US 2003/0167786 A1 Sep. 11, 2003

Related U.S. Application Data

(63) Continuation of application No. PCT/JP02/01902, filed on Mar. 1, 2002.

(30) Foreign Application Priority Data

Dec. 19, 2001 (JP) ..... 2001-386211

(51) Int. Cl.[7] ..... F25D 23/12
(52) U.S. Cl. ..... 62/285; 62/291
(58) Field of Search ..... 62/285, 288, 291

(56) References Cited

U.S. PATENT DOCUMENTS 6,557,364 B2 * 5/2003 Gunji et al. ..... 62/263

FOREIGN PATENT DOCUMENTS

| | | |
|---|---|---|
| JP | 4-106425 | 9/1992 |
| JP | 5-010541 | 1/1993 |
| JP | 5-10914 | 2/1993 |
| JP | 2000-291973 | 10/2000 |
| JP | 2001-090689 | 4/2001 |
| JP | 2001-141256 | 5/2001 |
| JP | 2001-311531 | 11/2001 |

* cited by examiner

*Primary Examiner*—William E. Tapolcal
(74) *Attorney, Agent, or Firm*—Oblon, Spivak, McClelland, Maier & Neustadt, P.C.

(57) ABSTRACT

An air conditioner having an air blower (1) for air blowing, a front heat exchanger (2) and a rear heat exchanger (3) respectively provided on the front side and the rear side of an indoor unit (10) so as to surround the air blower (1) and for carrying out heat exchange between the indoor air and a refrigerant, a rear drain pan (11) provided under this rear heat exchanger (3) and for receiving drained water, and an air blower air path (4) formed around the air blower (1) and narrowed near the front end portion of the drain pan (11). The lower portion of the rear heat exchanger (3) is located rearward in comparison with the upper portion of the rear heat exchanger (3) so as to be inclined backward. A louver (12) is provided to extend upward from the front upper portion of the rear drain pan (11) substantially along the shell of the air blower (1) so as to guide the air passing through the rear heat exchanger (3) to the air blower air path (4), and to catch drained water from the upper portion of the rear heat exchanger (3) and make the drained water flow into the rear drain pan (11).

5 Claims, 10 Drawing Sheets

AIR CONDITIONER

TECHNICAL FIELD

The present invention relates to an air conditioner for managing condensed water from the air cooled by a heat exchanger. Incidentally, drained water and dehumidified water will be used below in the same meaning as the condensed water.

BACKGROUND ART

Conventional air conditioners have a configuration as disclosed in JP-A-2001-906129. FIG. 7 shows this schematic configuration in section.

As shown in this drawing, in a conventional air conditioner, a front heat exchanger 2 and a rear heat exchanger 3 are provided in an air conditioner body 10 so as to surround an air blower 1. In addition, an air path 4 is provided so that the indoor air sucked from a front air inlet 10*a* and a top air inlet 10*b* provided in the front surface and the top surface of this air conditioner body 10 is passed through the above-mentioned heat exchangers 2 and 3 and the air blower 1 sequentially and blown out of a bottom air outlet 10*c* provided in the bottom surface of the body.

Furthermore, a rear drain pan 11 for recovering condensed water dropping from the rear heat exchanger 3 is provided under the rear heat exchanger 3. In addition, on the front side of this rear drain pan 11, a vortex flow stabilizing member 20 formed to extend upward along and between an air blower rear air path surface 4*b* and the rear heat exchanger 3 is provided to make the air, which passes through the rear heat exchanger 3, flow smoothly enough to prevent a vortex flow from occurring in the tongue portion of the air blower rear air path surface.

In the air conditioner in which the vortex flow stabilizing member 20 extends upward thus, the air passing through the rear heat exchanger 3 flows smoothly into the bottom air outlet 10*c*. As a result, the vortex flow in the tongue portion 4*c* of the air blower rear air path wall 4*b* becomes so small that the noise is reduced. However, the air passing through the rear heat exchanger 3 flows into the bottom air outlet 10*c* too smoothly to be mixed with the air passing through the front heat exchanger 2. Accordingly, for example, there may occur a difference in temperature between the front heat exchanger and the rear heat exchanger or there may occur a difference in temperature distribution depending on the flow of a refrigerant in the respective heat exchangers. In such a case, the air blower 1 is bedewed due to the difference in temperature with respect to the rotating direction of the air blower. Consequently, water drops jump out of the bottom air outlet 10*c*.

Further, as another conventional example of the prior art, there is an air conditioner as shown in FIG. 8.

In such an air conditioner, that is, in the air conditioner in which the drain pan 11 is extended simply, condensed water dropping from the rear heat exchanger 3 can be indeed recovered. A vortex flow, however, occurs to result in increase of the noise. Further, in the case where a difference in temperature distribution is caused by the refrigerant flow in the respective heat exchangers, or in the case where there occurs a difference in temperature between the front heat exchanger 2 and the rear heat exchanger 3, the air blower 1 is bedewed due to the difference in temperature. Consequently, water drops jump out of the bottom air outlet 10*c*.

Further, when the upper portion of the rear heat exchanger 3 is cooled sufficiently by the refrigerant flow in the rear heat exchanger so as to get wet with dehumidified water and the lower portion of the rear heat exchanger 3 gets dry, most of the dehumidified water flowing down from the upper portion does not flow to the lower portion due to the relationship of surface tension but flows directly to the front side of the rear heat exchanger 3 along the air flow to thereby drop to the air blower 1. As a result, water drops are blown out of the air outlet 10*c* so as to get the floor wet.

Further, in order to solve such problems, as shown in FIG. 9, the front end of the bottom portion of the rear drain pan 11 may be extended simply along the air flow path of the air blower 1 so that the tongue position of the air flow path reaches the central line of the air blower. However, in such a case, the suction area of the air path is reduced so that the air path resistance increases. Thus, the speed of the air passing through the front exchanger 2 increases. Consequently, as shown in FIG. 10, there arises a problem of discrete frequency noise depending on the number of blades and the number of revolutions of the air blower 1.

As described above, in the conventional air conditioners, there has been a problem that the air blower is bedewed or water drops jump out of the bottom air outlet when there occurs a temperature difference in the air in the air path.

Further, there has been a problem in discrete frequency noise depending on the number of blades and the number of revolutions of the air blower so that the noise increases.

The present invention was developed to solve the foregoing problems. It is an object of the invention to obtain an economical air conditioner which is silent and which restrains water drops from jumping out of an air outlet.

In addition, it is another object of the invention to obtain an economical air conditioner for managing condensed water easily with a small number of constituent parts.

DISCLOSURE OF THE INVENTION

According to the present invention, there is provided an air conditioner including an air blower for air blowing, a front heat exchanger and a rear heat exchanger respectively provided on a front side and a rear side of an indoor unit so as to surround the air blower and for carrying out heat exchange between indoor air and a refrigerant, a rear drain pan provided under the rear heat exchanger and for receiving drained water, and an air blower air path formed around the air blower and narrowed near a front end portion of the rear drain pan, a lower portion of the rear heat exchanger being located rearward in comparison with an upper portion of the rear heat exchanger so as to be inclined backward, the air conditioner being characterized in that: a louver is provided to extend upward from a front upper portion of the rear drain pan substantially along a shell of the air blower so as to guide air passing through the rear heat exchanger to the air blower air path, and to catch drained water dropping from the upper portion of the rear heat exchanger and make the drained water flow into the rear drain pan.

Further, the louver is arranged to vertically overlie an upper front end portion of the rear heat exchanger.

Further, a front end portion of the louver extends, with an angle equal to an inclination angle of the rear heat exchanger, to a position substantially corresponding to a position where a lowest stage radiator tube of the heat exchanger is placed.

Further, the rear drain pan is molded integrally with a wall surface constituting an air path of the air blower.

Further, in the air condition as stated in claim 4, the louver molded separately from the rear drain pan is attached to the rear drain pan.

Further, there is provided an air conditioner including an air blower for air blowing, a front heat exchanger and a rear heat exchanger respectively provided on a front side and a rear side of an indoor unit so as to surround the air blower and for carrying out heat exchange between indoor air and a refrigerant, a front drain pan and a rear drain pan respectively provided under the front heat exchanger and the rear heat exchanger and for receiving drained water, and a fixation plate member attached into the indoor unit and for fixing the front heat exchanger and the rear heat exchanger, the air conditioner being characterized in that: a gutter-like condensed water recovery mechanism (14) for guiding condensed water produced on the fixation plate member into the front drain pan or the rear drain pan is installed by molding integrally with the fixation plate member.

Further, the gutter-like condensed water recovery mechanism makes the rear drain pan and the front drain pan communicate with each other.

Further, the gutter-like condensed water recovery mechanism is provided on the outer side of the fixation plate member.

BEST MODE FOR CARRYING OUT THE INVENTION

Embodiment 1

Figure 1:
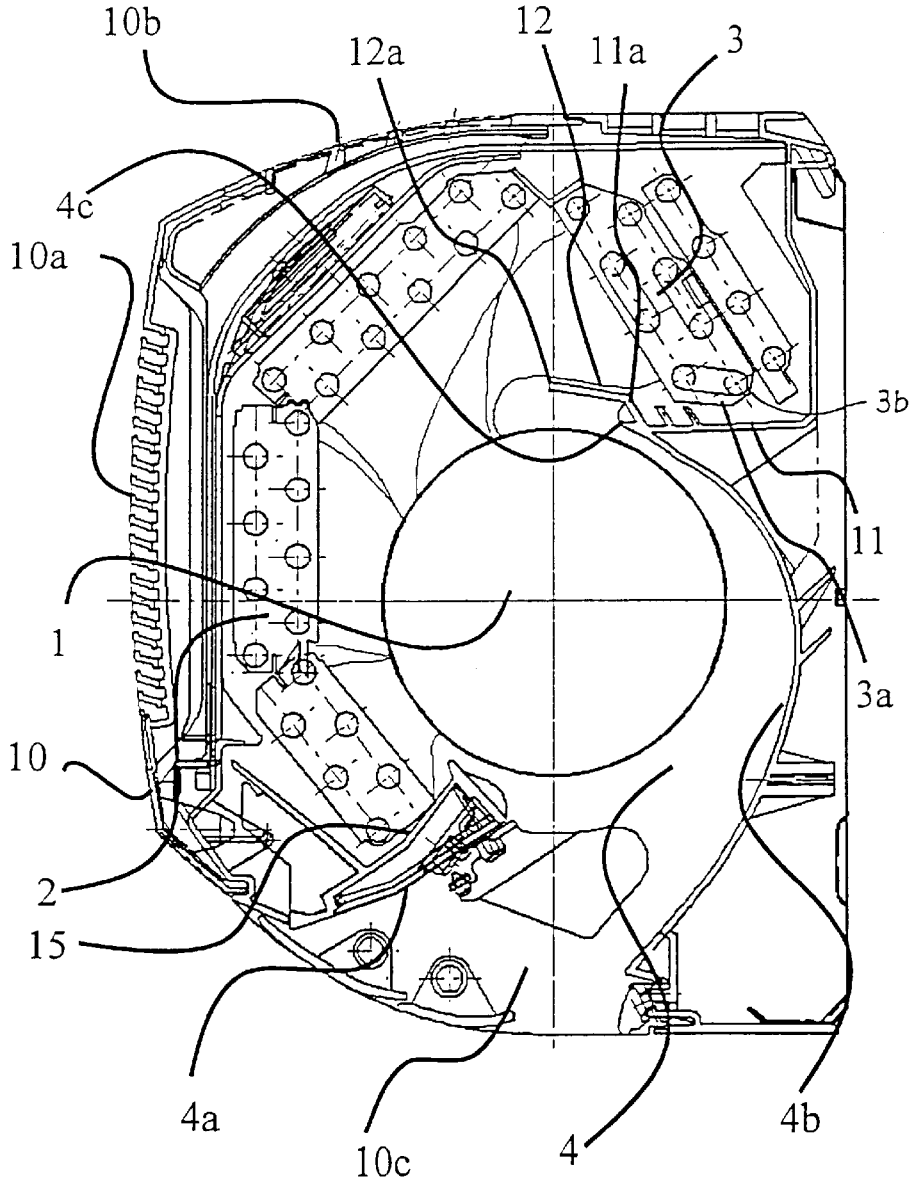
FIG. 1 is a sectional view showing an air conditioner in Embodiment 1 of the present invention.

Description will be made below about Embodiment 1 of the present invention with reference to FIG. 1. In this drawing, the reference numeral 1 represents an air blower provided in an air conditioner body and for circulating the indoor air; 2 and 3, a front heat exchanger and a rear heat exchanger provided to surround the front surface and the rear surface of this air blower 1 respectively and for carrying out heat exchange between the indoor air and a refrigerant; and 4, an air blower air path through which the indoor air from the front heat exchanger 2 and the rear heat exchanger 3 is blown out to the room through an air outlet 10*c* in the bottom surface of the air conditioner body. This air blower air path 4 is formed out of a front air path wall 4*a* and a rear air path wall 4*b*. A tongue portion 4*c* of this rear air path wall 4*b* is made to communicate with a rear drain pan 11.

Incidentally, the above-mentioned rear heat exchanger 3 is configured so that its lower portion is inclined rearward in comparison with its upper portion with respect to the vertical direction of the air conditioner body in view of the relationship between the air pass area of the rear heat exchanger 3 and the flow of condensed water.

In addition, the reference numeral 10 represents an air conditioner body unit. This body unit 10 has a front air inlet 10*a* in its front surface and a top air inlet 10*b* in its top surface, and has a unit air outlet 10*c* in its bottom surface. These air inlets 10*a* and 10*b* and the air outlet 10*c* communicate with one another through the air path wall. The reference numeral 11 represents a rear drain pan provided under the rear heat exchanger 3 provided in this air path wall, and for recovering drained water such as condensed water or the like from the heat exchanger in question. The reference numeral 12 represents a louver provided for guiding the indoor air from the rear heat exchanger 3. The louver 12 extends upward obliquely along the shell shape of the impeller of the air blower 1 from the front upper portion of this rear drain pan 11 (the position corresponding to the lowest surface 3*a* of the rear heat exchanger 3) to the position corresponding to the horizontal position of the upper front end portion of the rear heat exchanger 3.

Next, description will be made on the operation of this configuration.

First, the indoor air respectively sucked from the front air inlet 10*a* and the top air inlet 10*b* of the air conditioner body 10 pass through the front heat exchanger 2 and the rear heat exchanger 3 respectively so as to be heat-exchanged with the refrigerant in the heat exchangers. The heat-exchanged indoor air is blown out of the unit air outlet 10*c* through the air blower air path 4 by the air blower 1, and then sucked from the front air inlet 10*a* and the top air inlet 10*b* again. Thus, operation similar to the aforementioned operation is repeated.

Incidentally, at this time, the upper-side air of the air passing through the rear heat exchanger 3 flows downward by the sucking force of the air blower 1. On the other hand, the lower-side air of the air passing through the rear heat exchanger 3 flows in accordance with the guide of the louver 12 provided on the front upper portion 11*a* of the rear drain pan 11. Those upper-side air and the lower-side air of the air are blown together out of the air outlet 10*c* through the tongue portion 4*c* of the rear air path wall 4*b* by the air blower 1.

According to this configuration, even if the refrigerant in the rear heat exchanger 3 is unbalanced so that the upper portion of the rear heat exchanger 3 gets wet while the lower portion thereof gets dry, with the result that there occurs a temperature difference between the upper-side air and the lower-side air of the air in the rear heat exchanger 3, the upper-side air and the lower-side air of the air are well mixed with each other near the louver 12 so as to be uniform in temperature. Accordingly, it becomes difficult to produce condensed water. In addition, as a result of such operation, the speed of the air from the rear heat exchanger 3 increases so that the air is well mixed with the air from the front heat exchanger 2. Thus, the production of condensed water can be further prevented.

In addition, at this time, when the upper portion of the rear heat exchanger 3 is cooled sufficiently so as to get wet with dehumidified water while the lower portion thereof gets dry, most of the dehumidified water flowing down from the upper portion does not flow to the lower portion due to the relationship of surface tension but flows and drops directly to the front side of the rear heat exchanger 3 along the flow of the air. However, as shown in FIG. 1, the louver 12 is disposed to receive the air pass exit surface of the rear heat exchanger 3, that is, so that the front end portion 12*a* of the louver 12 and the front end portion of the rear heat exchanger 3 are substantially overlaid on each other vertically. In addition, the louver 12 is placed to be inclined to the drain pan 11. Accordingly, even if condensed water is produced, the condensed water is caught by the louver 12 and flows to the drain pan 11. Therefore, the condensed water is prevented from blowing out of the body air outlet 10*c* into the room through the air outlet of the air blower air path 4. Thus, there is no fear that the floor in the room or the like gets wet with the condensed water.

Figure 6:
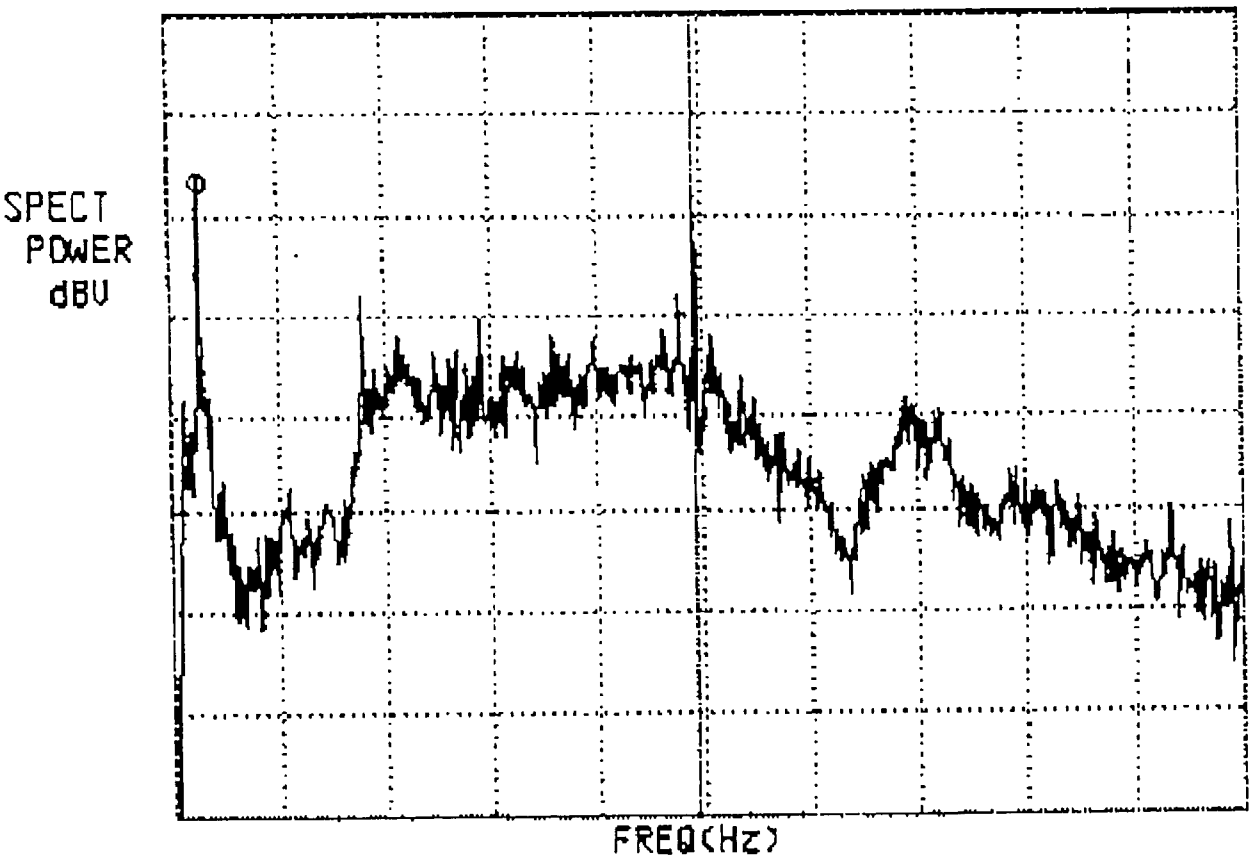
FIG. 6 is a graph of the frequency analysis result of noise when a louver according to the present invention is attached.
Figure 7:
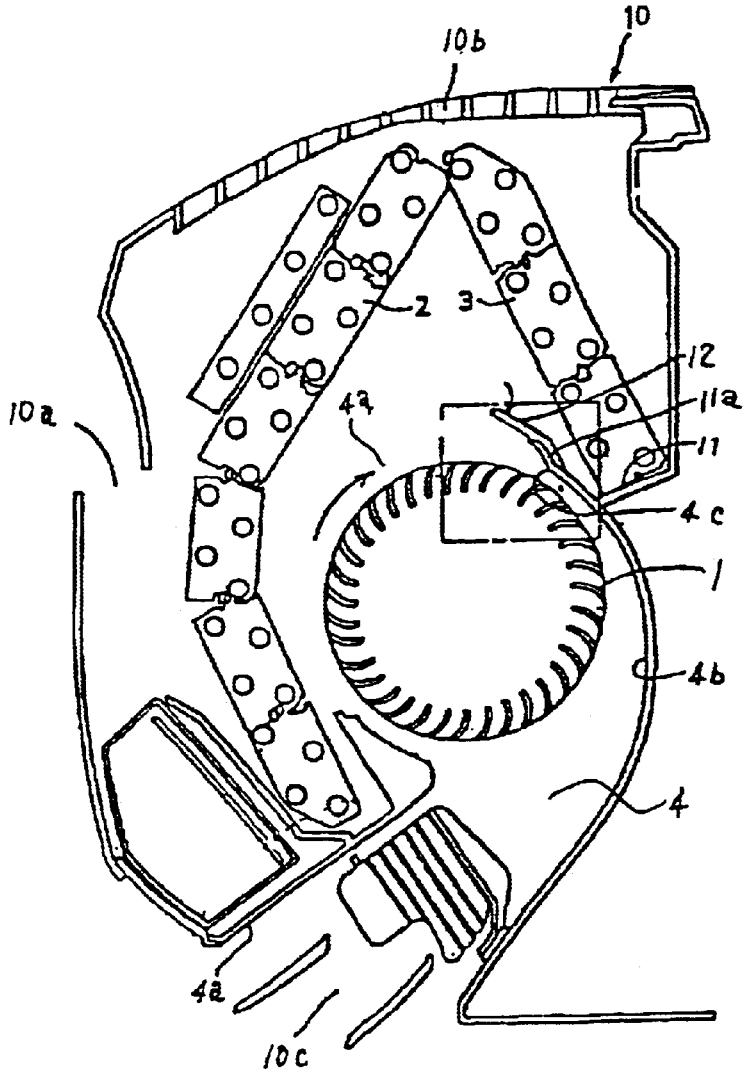
FIG. 7 PRIOR ART
FIG. 7 is a sectional view of a conventional air conditioner.
Figure 8:
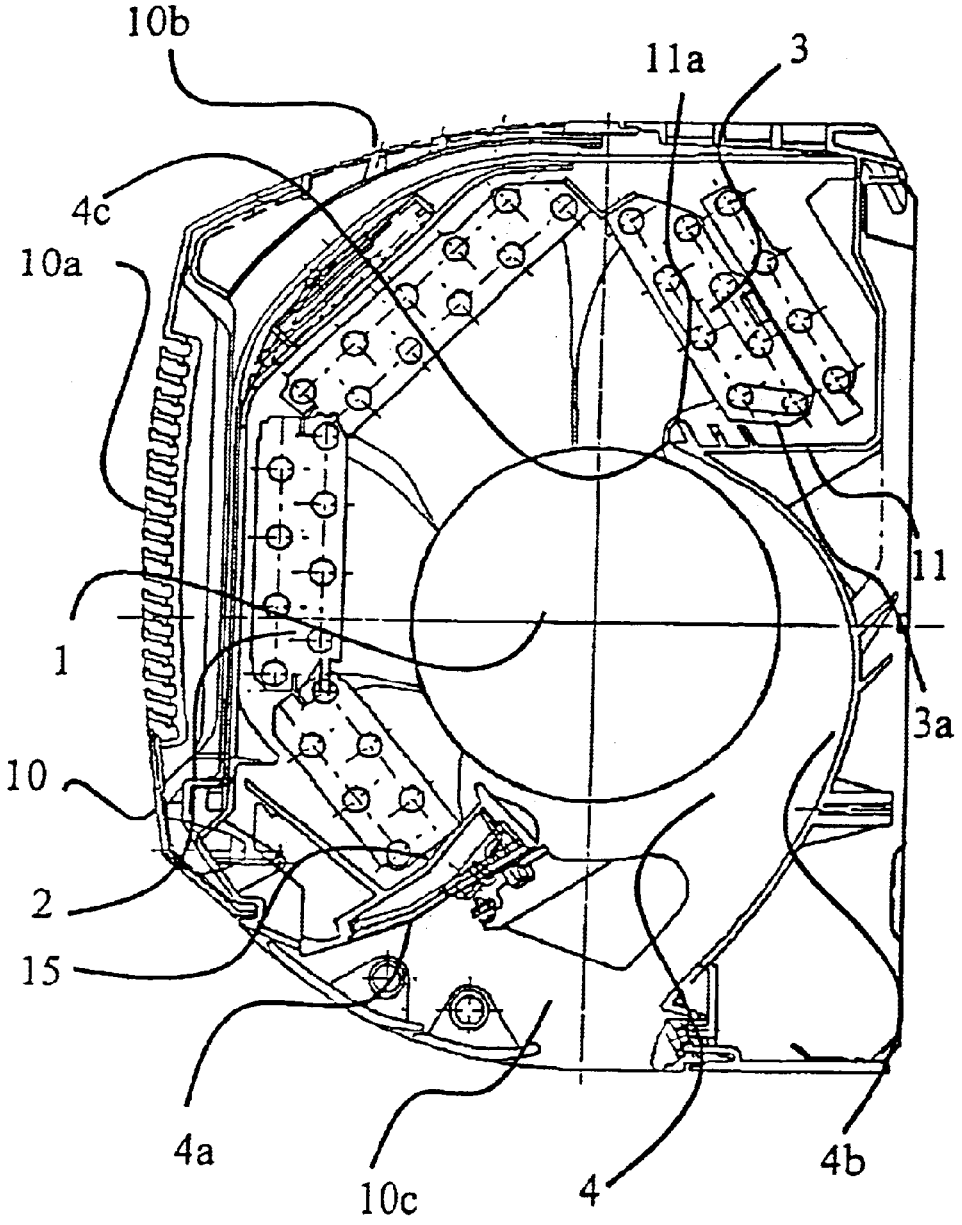
FIG. 8 PRIOR ART
FIG. 8 is a sectional view of another conventional air conditioner.
Figure 9:
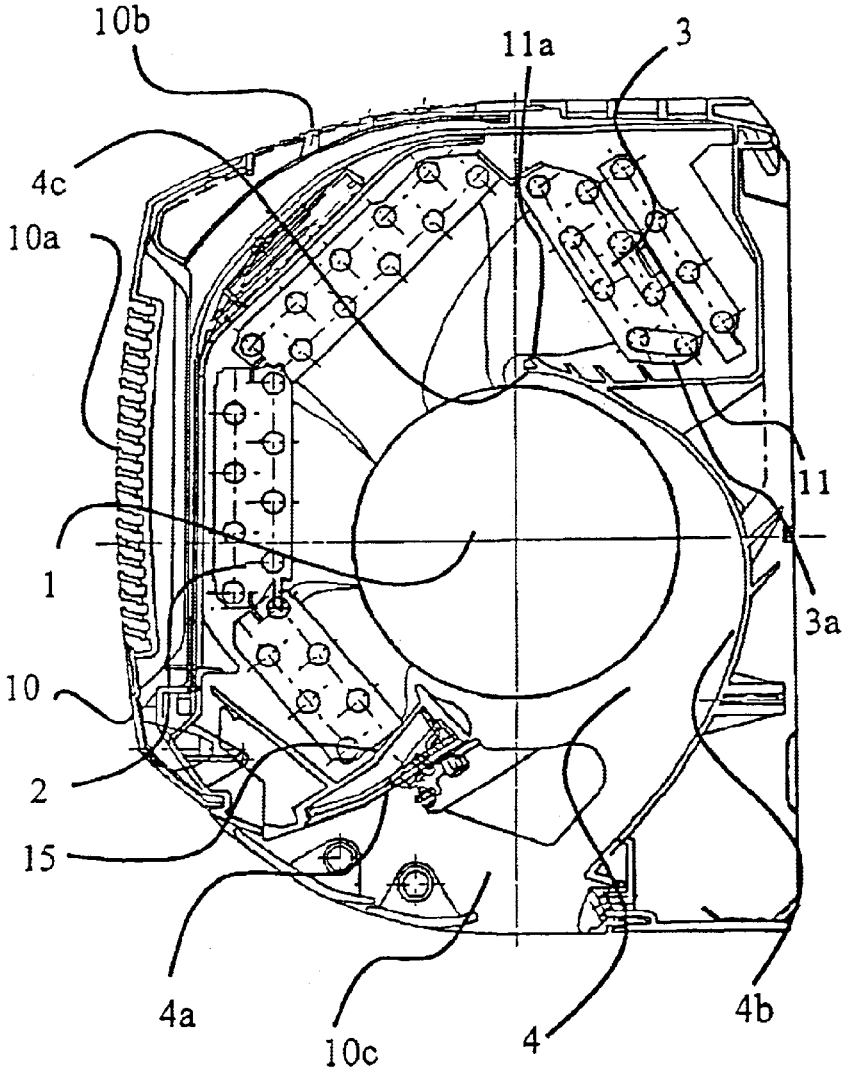
FIG. 9 PRIOR ART
FIG. 9 is a sectional view of a further conventional air conditioner.
Figure 10:
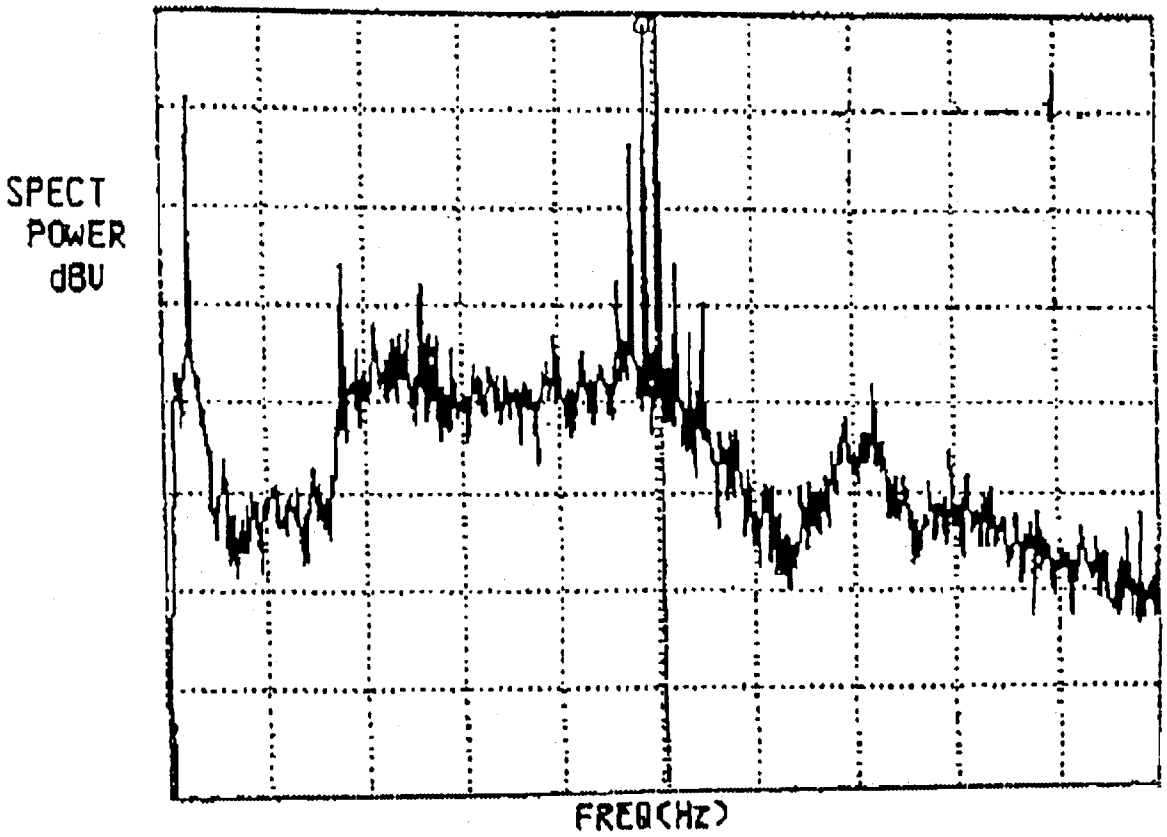
FIG. 10 PRIOR ART
FIG. 10 is a graph of the frequency analysis result of noise in the background art.

In addition, the louver 12 is extended from the drain pan front upper portion 11*a* so as to reach the horizontal position corresponding to the upper front end of the rear heat exchanger 3 substantially along the shell shape of the impeller of the air blower 1. Accordingly, the suction air path area of the air inlet of the air blower air path 4 is secured to prevent the air path resistance from increasing. In addition, according to this configuration, as shown in FIG. 6, the production of discrete frequency noise depending on the number of blades or the number of revolutions of the air blower 1 is suppressed.

The above description has been made on the case where the front end portion 12*a* of the louver 12 and the front end portion of the rear heat exchanger 3 are overlaid on each other vertically so that the condensed water from the rear heat exchanger 3 caught by the louver 12 flows to the rear drain pan 11. Not to say, however, in some relationship between the inclination angle of the rear heat exchanger 3 and the speed of the air passing through the rear heat exchanger 3, those front end portions do not always have to be overlaid on each other.

Embodiment 2

This Embodiment 2 will be described with reference to FIG. 2.

Figure 2:
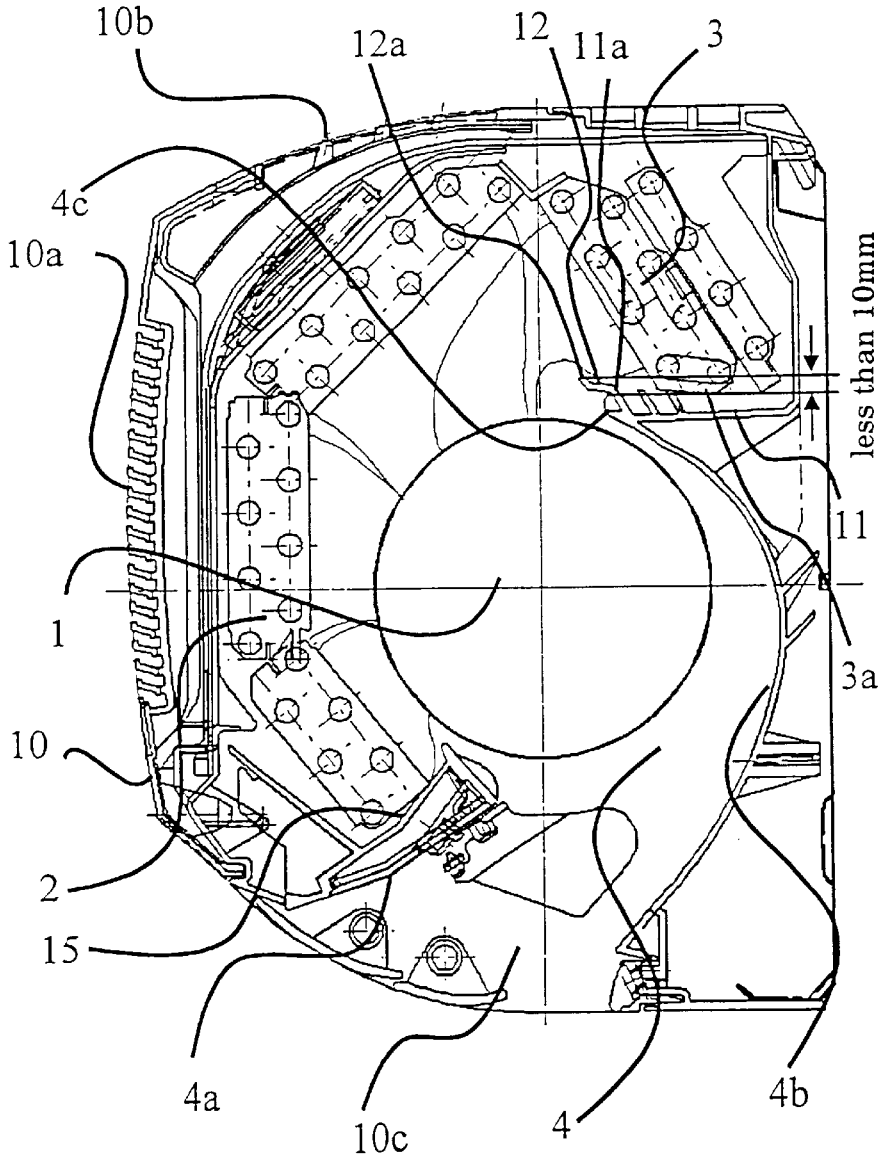
FIG. 2 is a sectional view showing an air conditioner in Embodiment 2 of the present invention.

In this Embodiment 2, as shown in FIG. 2, when the louver 12 is extended from the front upper portion 11*a* of the rear drain pan 11, the front end portion of the louver 12 is formed into a slope having substantially the same angle as the inclination angle of the rear heat exchanger 3 so as to cover the exit-side inclined surface of the rear heat exchanger 3. In addition, the height with which the louver 12 is extended is set to reach a position (or height) about 10 mm above the lowest surface 3*a* of the rear heat exchanger 3 or substantially corresponding to the position where the lowest stage radiator tube 3*b* of the rear heat exchanger 3 is placed.

Incidentally, the other configuration is substantially the same as that in Embodiment 1.

Next, description will be made about the operation of this configuration.

First, with such a configuration, the upper-side air of the air passing through the rear heat exchanger 3 flows downward by the sucking force of the air blower 1. On the other hand, the lower-side air of the air passing through the rear heat exchanger 3 is guided further upward by the front end portion 12*a* of the louver 12 provided on the front upper portion 11*a* of the rear drain pan 11. Accordingly, the upper-side air and the lower-side air of the air in the rear heat exchanger 3 are well mixed with each other so as to be uniform in temperature. Thus, the floor in the room or the like is further prevented from getting wet with condensed water.

Even if the refrigerant in the rear heat exchanger 3 is unbalanced so that the upper portion of the rear heat exchanger 3 is cooled sufficiently to get wet with dehumidified water (drained water) while the lower portion thereof gets dry, most of the dehumidified water flowing down from the upper portion does not flow to the lower portion due to the relationship of surface tension but flows directly to the front side of the rear heat exchanger 3 along the flow of the air. Accordingly, even if the drained water drops down, the drained water is caught by the louver 12 and flows to the rear drain pan 11. Therefore, there is no fear that the floor in the room or the like gets wet with the condensed water. In addition, since the height with which the louver 12 is extended is set to be lower than the rear heat exchanger 3, there is no fear the heat radiation capacity (area) of the rear heat exchanger 3 is spoilt.

Further, when the suction side of the air blower air path 4 is varied gradually in such a manner, the air flows so smoothly that the production of a vortex flow can be suppressed, and the production of discrete frequency noise depending on the number of blades or the number of revolutions of the air blower 1 can be further prevented. Thus, it is possible to obtain a silent air conditioner.

Embodiment 3

Figure 3:
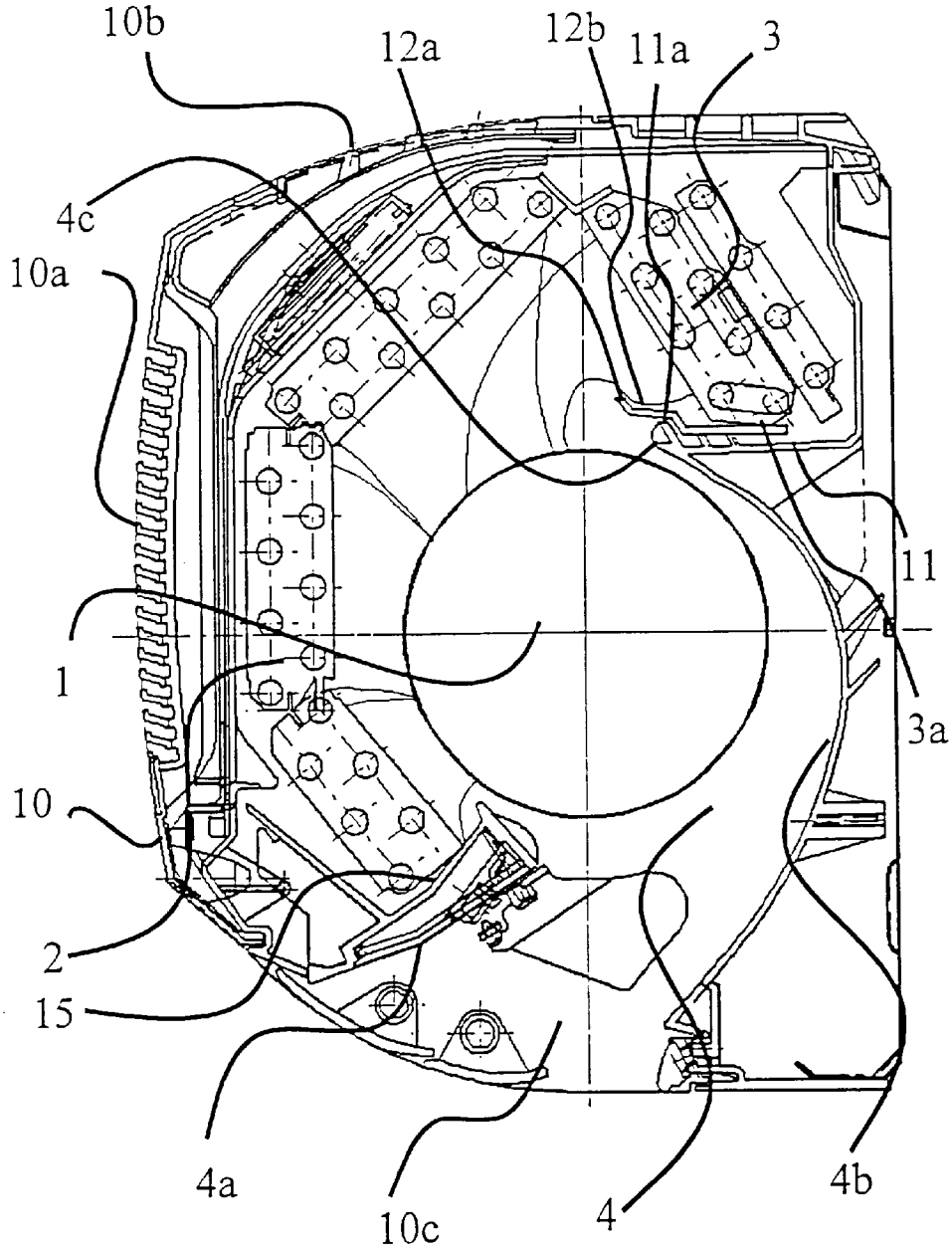
FIG. 3 is a sectional view showing an air conditioner in Embodiment 3 of the present invention.

In this Embodiment 3, as shown in FIG. 3, the rear drain pan 11 and the rear air path wall 4*b* of the air blower air path 4 in Embodiment 1 or 2 are molded integrally. On the other hand, the louver 12 is formed as a part separated from these parts, and then attached to the rear drain pan 11.

Incidentally, the other configuration is substantially the same as that in Embodiment 1 or 2.

Incidentally, when the rear drain pan 11 and the louver 12 are formed separately to be assembled then, the shape of a mold for a unit air path with the rear drain pan 11 or the louver 12 becomes simple. In addition, since the louver 12 can be attached after the rear heat exchanger 3 is attached, not only are the mold cost and the material cost reduced, but the assembling performance is also improved. In addition, since the degree of freedom for the design of the louver 12 is improved, it is possible to obtain an economical air conditioner improved in the degree of freedom of design.

Embodiment 4

Figure 4:
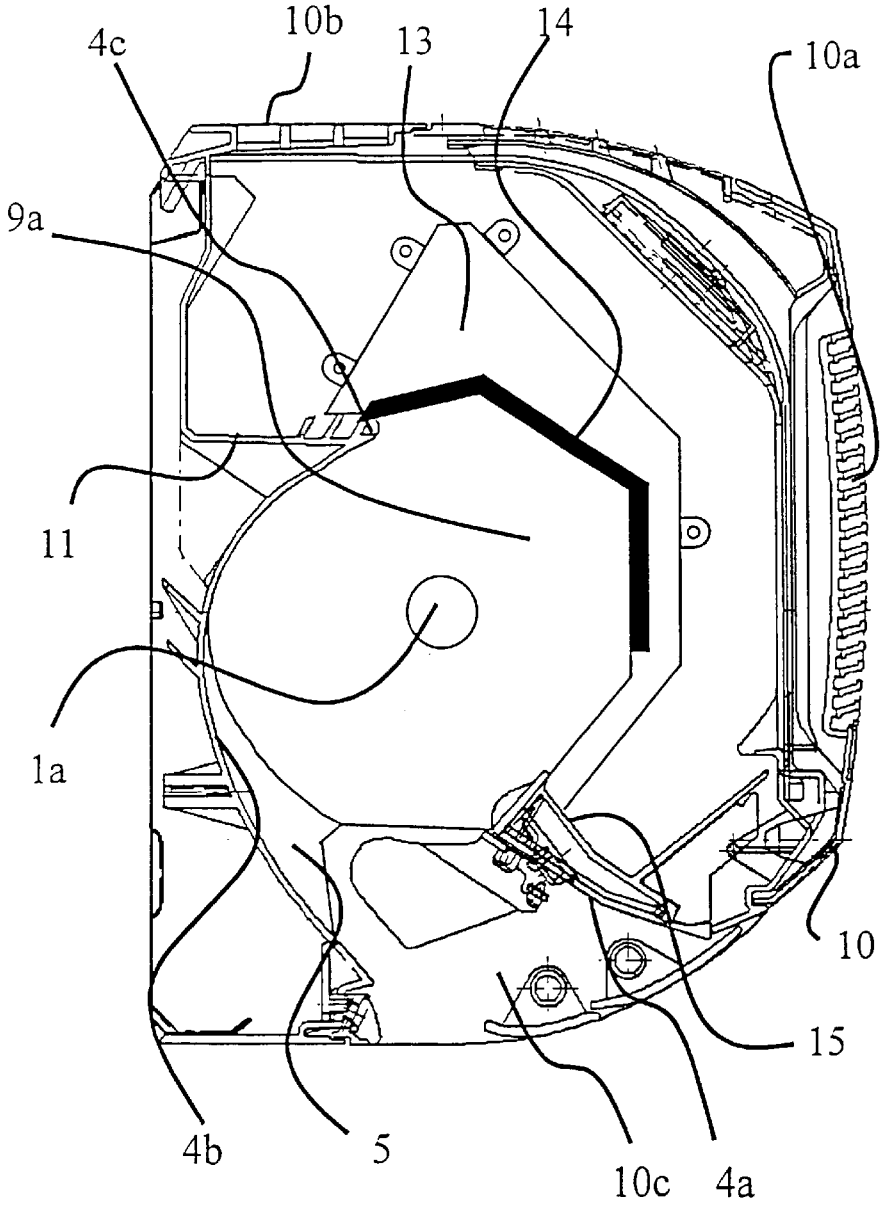
FIG. 4 is a schematic configuration view of a condensed water recovery mechanism of an air conditioner in Embodiment 4 of the present invention.
Figure 5:
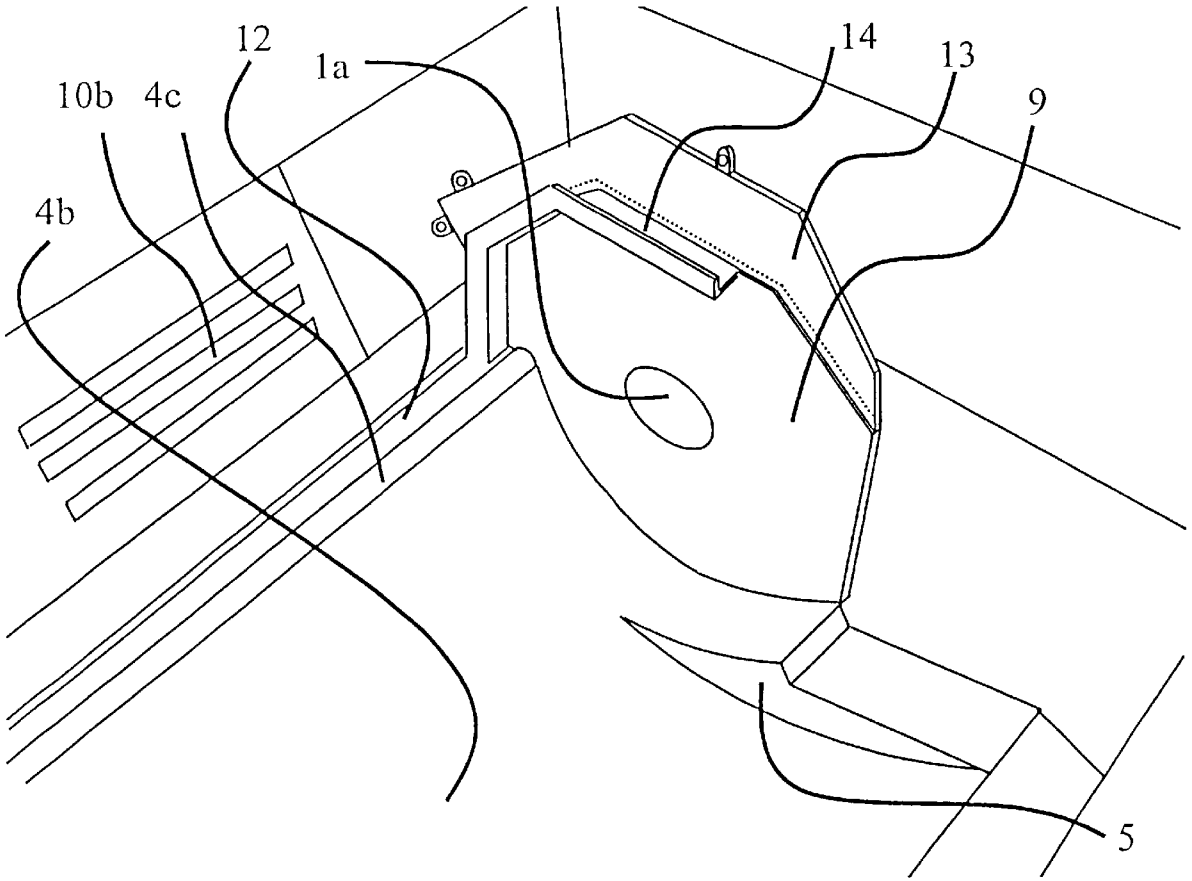
FIG. 5 is a schematic perspective view of the condensed water recovery mechanism of the air conditioner in Embodiment 4 of the present invention.

In this Embodiment 4, as shown in FIGS. 4 and 5, a fixation plate member 13 for fixing the front heat exchanger 2 and the rear heat exchanger 3 forms a side surface of an air path wall of the body unit, and a gutter-like condensed water recovery mechanism 14 for guiding condensed water produced in the fixation plate member 13 into a front drain pan 15 or a rear drain pan 11 is provided on the fixation plate member 13.

Incidentally, the other configuration is substantially the same as that in Embodiment 1 or 2.

Next, the operation of the configuration arranged thus will be described with reference to FIGS. 4 and 5.

First, when the refrigerant flows into the front heat exchanger 2 and the rear heat exchanger 3, the fixation plate member 13 fixing and supporting these heat exchangers 2 and 3 is cooled. Accordingly, when the warm air comes in contact with it so as to be dehumidified and cooled, condensed water is produced on the fixation plate member 13. The condensed water adheres to the fixation plate member 13, soon grows up and flows down from the upper portion of the fixation plate member 13 so as to have a tendency to fall down to the air blower 1 or the drain pan 11 or 15.

However, the gutter-like condensed water recovery mechanism 14 is provided on the lower portion of the fixation plate member 13 fixing the front heat exchanger 2 and the rear heat exchanger while the lower portion is the portion where the respective heat exchangers are fixed, so that the condensed water produced on the fixation plate member 13 is recovered by the condensed water recovery mechanism 14 and is guided to the front drain pan 15 or the rear drain pan 11. Thus, the condensed water adhering to the fixation plate member 13 is received in the front drain pan 15 or the rear drain pan 11 without dropping to the air blower 1.

As described above, the gutter-like condensed water recovery mechanism 14 is provided on the lower portion of the fixation plate member 13 where the respective heat exchangers 2 and 3 are located so that the condensed water is guided to the front drain pan 15 or the rear drain pan 11. Thus, it is possible to obtain an air conditioner in which condensed water on the fixation plate member is recovered so that the condensed water is prevented from flying out. Incidentally, it is preferable from the point of view of assembling performance or economical efficiency that the condensed water recovery mechanism 14 is molded integrally with the fixation plate member 13.

In addition, when the front drain pan 15 and the rear drain pan 11 communicate with each other directly or indirectly by use of this gutter-like condensed water recovery mechanism 14, drained water in the rear drain pan 11 which is at a higher place flows into the front drain pan 15 which is at a lower place. Accordingly, discharge pipes for discharging drained water to the outside of the air conditioner can be arranged in order and the number of the discharge pipes can be reduced. It is therefore possible to obtain an economical air conditioner.

In addition, although the above description has been made on the case where the gutter-like condensed water recovery mechanism 14 was provided on the inner side of the fixation plate member 13, that is, on the heat exchanger side, the gutter-like condensed water recovery mechanism 14 may be provided on the outer side of the fixation plate member 13.

Further, the rear drain pan 11 and the front drain pan 15 are not limited to those which are located inside the fixation plate member 13. That is, these drain pans may be extended to the outside of the fixation plate member 13.

As described above, according to the present invention, it is possible to obtain an air conditioner in which the production of discrete frequency noise depending on the number of blades or the number of revolutions of the air blower is prevented while the temperature is made so uniform that condensed water is hard to be produced. In addition, even if condensed water is produced, the condensed water flows into the drain pan so that the condensed water is prevented from blowing or dropping down into the room.

In addition, the louver is designed to vertically overlie the upper front end portion of the rear heat exchanger. Accordingly, even if condensed water is produced, most of the condensed water flows from the louver into the drain pan so that the condensed water is prevented from blowing or dropping down into the room.

In addition, the front end portion of the louver extends, with the same angle as the inclination angle of the rear heat exchanger, to a position substantially corresponding to the position where the lowest stage radiator tube of the heat exchanger in question is placed. Accordingly, the air path area of the air blower is varied gradually without spoiling the air path area of the heat exchanger so that the air is made to flow smoothly while the production of a vortex flow or the production of discrete frequency noise is suppressed. It is therefore possible to obtain a silent air conditioner having superior performance.

In addition, when the rear drain pan is molded integrally with the air path wall of the air blower, it is possible to obtain an air conditioner in which the number of constituent parts is reduced and the assembling performance is superior.

In addition, when the louver is formed as a separate part from the rear drain pan, the shapes of molds for molding those parts can be made simple. In addition, because the louver can be attached then, it is possible to obtain an economical air conditioner in which the mold cost and the material cost are low and the assembling performance is superior.

In addition, the gutter-like condensed water recovery mechanism by which condensed water produced on the fixation plate member for fixing the front and rear heat exchangers is guided into the front drain pan or the rear drain pan is provided on the fixation plate member. Accordingly, the condensed water is restrained from flying out of the air outlet.

In addition, when the gutter-like condensed water recovery mechanism makes the rear drain pan and the front drain pan communicate with each other directly or indirectly, the discharge pipes for discharging drained water can be arranged in order and the number of the discharge pipes can be reduced. It is therefore possible to obtain an economical air conditioner.

Further, when the gutter-like condensed water recovery mechanism is provided on the outer side of the fixation plate member, it is possible to obtained an air conditioner in which the condensed water can be restrained from flying into the room with a simpler configuration.

Description of Reference Numerals

1 air blower, 2 front heat exchanger, 3 rear heat exchanger, 3*a* rear heat exchanger lowest surface, 4 air blower air path, 4*a* air blower front air path or air blower front air path wall, 4*b* air blower rear air path or air blower rear air path wall, 4*c* tongue portion, 10 air conditioner body unit, 10*a* front unit air inlet, 10*b* top unit air inlet, 10*c* bottom unit air outlet, 11 rear drain pan, 11*a* rear drain pan front surface, 12 louver, 12*a* louver front end portion, 13 fixation plate member, 14 condensed water recovery mechanism, and 15 front drain pan.

What is claimed is:

1. An air conditioner comprising an air blower for air blowing, a front heat exchanger and a rear heat exchanger respectively provided on a front side and a rear side of an indoor unit so as to surround said air blower and for carrying out heat exchange between indoor air and a refrigerant, a rear drain pan provided under said rear heat exchanger and for receiving drained water, and an air blower air path formed around said air blower and narrowed near a front end portion of said drain pan, a lower portion of said rear heat exchanger being located rearward in comparison with an upper portion of said rear heat exchanger so as to be inclined backward, said air conditioner comprising:

a louver provided to extend upward from a front upper portion of said rear drain pan substantially along a shell of said air blower to guide air passing through said rear heat exchanger to said air blower air path, and to catch drained water from said upper portion of said rear heat exchanger and make said drained water flow into said rear drain pan.

2. An air conditioner according to claim 1, wherein said louver is arranged to vertically overlie an upper front end portion of said rear heat exchanger.

3. An air conditioner according to claim 1, wherein a front end portion of said louver extends, with an angle equal to an inclination angle of said rear heat exchanger, to a position substantially corresponding to a position where a lowest stage radiator tube of said heat exchanger is placed.

4. An air conditioner according to any one of claims 1 to 3, wherein said rear drain pan is molded integrally with a wall surface constituting an air path of said air blower.

5. An air conditioner according to claim 4, wherein said louver molded separately from said rear drain pan is attached to said rear drain pan.

* * * * *